US011659909B2

(12) United States Patent
Lin et al.

(10) Patent No.: US 11,659,909 B2
(45) Date of Patent: May 30, 2023

(54) MULTIFUNCTIONAL HAIR STRAIGHTENING AND CURLING DEVICE

(71) Applicant: DONGGUAN BIDISCO ELECTRIC CO., LTD., Dongguan (CN)

(72) Inventors: Qiongquan Lin, Dongguan (CN); Shenglong Wei, Dongguan (CN); Shengquan Wang, Dongguan (CN); Taiqiao Yin, Dongguan (CN); Peikai Zhu, Dongguan (CN)

( * ) Notice: Subject to any disclaimer, the term of this patent is extended or adjusted under 35 U.S.C. 154(b) by 158 days.

(21) Appl. No.: 16/258,653

(22) Filed: Jan. 27, 2019

(65) Prior Publication Data

US 2020/0069021 A1 Mar. 5, 2020

Related U.S. Application Data

(63) Continuation of application No. PCT/CN2018/110032, filed on Oct. 12, 2018.

(30) Foreign Application Priority Data

Aug. 29, 2018 (CN) ..... 201821399541.6

(51) Int. Cl.

| | |
|---|---|
| ***A45D 1/04*** | (2006.01) |
| ***A45D 2/00*** | (2006.01) |
| ***A45D 1/06*** | (2006.01) |

(52) U.S. Cl.

CPC ..... *A45D 1/04* (2013.01); *A45D 1/06* (2013.01); *A45D 2/001* (2013.01)

(58) Field of Classification Search

CPC ..... A45D 20/10; A45D 20/50; A45D 1/08; A45D 1/06; A45D 2001/004;

(Continued)

(56) References Cited

U.S. PATENT DOCUMENTS 2,362,748 A * 11/1944 Francis ..... A45D 1/04 132/232
3,698,402 A * 10/1972 Arnesen ..... A45D 20/12 392/383

(Continued)

FOREIGN PATENT DOCUMENTS

DE 102011006495 A1 * 10/2012 ..... A45D 1/06
GB 142370 A * 5/1920 ..... B25B 7/04

(Continued)

*Primary Examiner* — Jacqueline T Johanas
*Assistant Examiner* — Sarah Woodhouse

(57) ABSTRACT

The present invention provides a multifunctional hair straightening and curling device, including: an upper main body, a lower main body and a handle, wherein the upper heating body is disposed on the upper main body, the lower heating body is disposed on the lower main body, one end of the upper heating body and one end of the lower heating body are rotatably connected by a rotary shaft, a button is disposed on the upper main body, the upper surface of the upper main body is provided with first air outlets, the upper main body is provided with a first air outlet passage therein, the lower surface of the lower main body is provided with second air outlets, the lower main body is provided with a second air outlet passage therein, the handle is provided with a fan therein.

4 Claims, 5 Drawing Sheets

(58) Field of Classification Search
CPC ..... A45D 2001/006; A45D 2001/008; A45D 2001/002; A45D 2001/045; A45D 2/00; A45D 2/001; A45D 29/02; A45D 29/023; A45D 29/026; A45D 1/00; A45D 1/02; A45D 1/04; A45D 1/12; A45D 1/14; A45D 1/16; A45D 1/18; A45D 1/20; A45D 1/28; B25B 7/12; B25B 7/18
USPC ..... 132/224, 225, 226, 227, 228, 229, 231, 132/232, 234, 244, 249, 256, 257, 261, 132/263, 271, 272, 269; 81/344, 373, 81/374, 375, 376, 377, 378, 379, 380, 81/381, 382, 383, 383.5, 384, 385, 386, 81/387
See application file for complete search history.

(56) References Cited

U.S. PATENT DOCUMENTS 3,779,255 A * 12/1973 Theodorides ..... A45D 1/06 132/255
4,442,849 A * 4/1984 Kawabe ..... A45D 1/04 132/232
6,514,197 B1 * 2/2003 Ouchi ..... B25B 7/12 600/129
7,064,285 B2 * 6/2006 Ichimaru ..... E05F 17/004 49/503
8,002,784 B2 * 8/2011 Jinno ..... A61B 34/70 606/174
2005/0183940 A1 * 8/2005 Ichimaru ..... E05F 1/1066 200/523
2008/0041409 A1 * 2/2008 Leung ..... A45D 1/04 132/224
2008/0236609 A1 * 10/2008 Wong ..... A45D 1/04 132/226
2009/0133207 A1 * 5/2009 Dale ..... B05C 17/0217 15/230.11
2010/0011917 A1 * 1/2010 Wu ..... B25B 5/103 81/395
2014/0137887 A1 * 5/2014 Cocks ..... A45D 2/001 132/224
2015/0173480 A1 * 6/2015 Washington ..... A45D 2/367 132/206
2015/0251256 A1 * 9/2015 Frenken ..... H01R 43/0428 100/234

FOREIGN PATENT DOCUMENTS

JP 5388113 B2 * 1/2014
KR 100702659 B1 * 3/2007
WO WO1988008240 A1 * 4/1987
WO WO-2020258115 A1 * 12/2020

* cited by examiner

MULTIFUNCTIONAL HAIR STRAIGHTENING AND CURLING DEVICE

FIELD OF THE DISCLOSURE

The present invention relates to the field of hair curlers, and in particular to a multifunctional hair straightening and curling device.

BACKGROUND

The multifunctional hair curlers on the market generally have only one single function, either hair straightening or hair curling. The curler products on the market generally heat a cylindrical aluminum tube or iron tube to a certain temperature for hair curling. The hair is wound on the aluminum tube or iron tube at a certain temperature for a certain period of time, and the setting speed of curly hair is very slow.

SUMMARY

An objective of the present invention is to provide a multifunctional hair straightening and curling device capable of saving hair curling time and fast in setting of curly hair.

In order to achieve the above objective, the present invention provides the following technical solution.

The multifunctional hair straightening and curling device includes an upper main body, a lower main body and a handle, wherein the upper main body and the lower main body are disposed oppositely, one end of each of the upper main body and the lower main body is mounted on the end part of the handle, an upper heating body and a lower heating body are disposed between the upper main body and the lower main body respectively, the upper heating body is disposed on the upper main body, the lower heating body is disposed on the lower main body, one end of the upper heating body and one end of the lower heating body are rotatably connected by a rotary shaft, a button is disposed on the upper main body, the button is capable of controlling the upper heating body and the lower heating body to perform opening-closing movement, the upper surface of the upper main body is provided with first air outlets, the upper main body is provided with a first air outlet passage therein, the lower surface of the lower main body is provided with second air outlets, the lower main body is provided with a second air outlet passage therein, the handle is provided with a fan therein, the fan is capable of blowing generated wind out from the first air outlets through the first air outlet passage, and the fan is capable of blowing the generated wind out from the second air outlets through the second air outlet passage.

Further, the upper heating body and the lower heating body are capable of opening for a certain angle, and the vertical width between the upper heating body and the lower heating body ranges from 1 mm to 8 mm.

Further, the upper heating body and the lower heating body are connected in a scissor shape by a rotary shaft, a rotary handle is disposed on the right end of the upper heating body and the lower heating body, the left end of the rotary handle is provided with a boss part capable of abutting against the right end of the lower heating body, the right end of the rotary handle is provided with an extending part capable of abutting against the right end of the upper heating body, and the extending part is bent rightwards and extends upwardly and is connected to the lower end of the button.

The present invention has the following beneficial effects.

The multifunctional hair straightening and curling device not only can straighten but also can curl the hair. During hair curling, the upper surface of the upper main body is provided with the first air outlets, the upper main body is provided with the first air outlet passage therein, the lower surface of the lower main body is provided with the second air outlets, the lower main body is provided with the second air outlet passage therein, the handle is provided with the fan therein, the fan is capable of blowing generated wind out from the first air outlets through the first air outlet passage, and the fan is capable of blowing the generated wind out from the second air outlets through the second air outlet passage. The hair is heated and softened by the upper heating body and the lower heating body, and is then curled on a cylindrical body combined by the upper main body and the lower main body and having the air outlets. Under the radiating action of wind, the hair is cooled and set instantly, and moves toward the direction opposite to hair roots. The multifunctional hair straightening and curling device will generate a continuous hair curling effect, and thus saves a lot of time. Multiple different hair set effects can be curled according to the moving speed of the multifunctional hair straightening and curling device.

DETAILED DESCRIPTION OF PREFERRED EMBODIMENTS

The present invention will be further explained in conjunction with the accompanying drawings.

Figure 1:
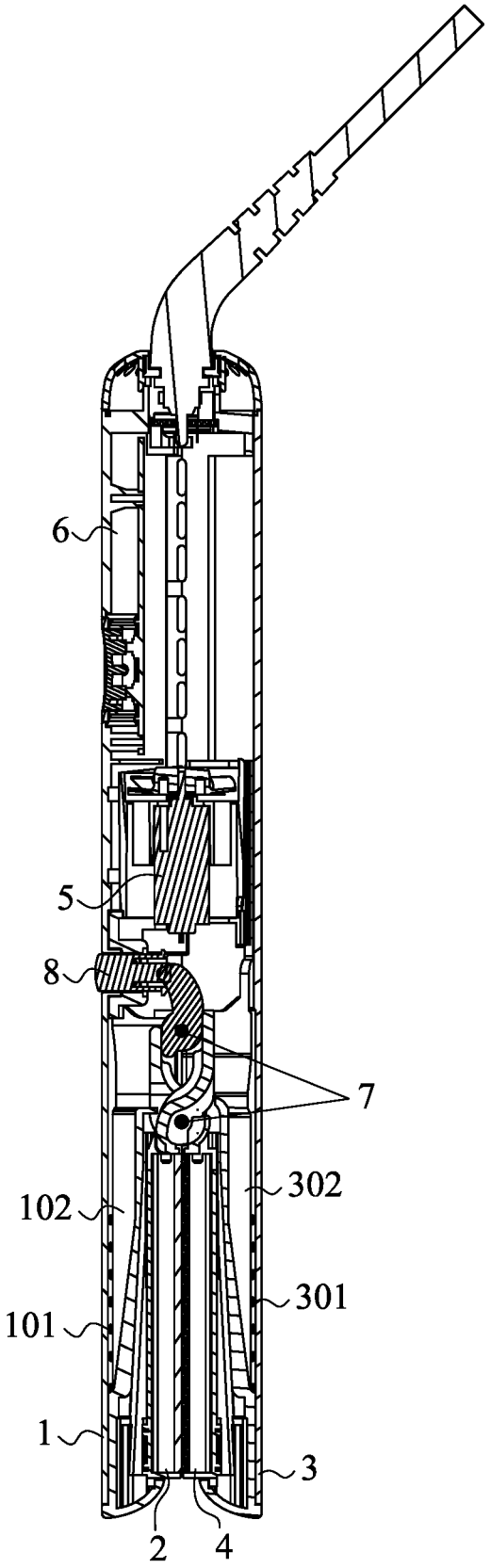
FIG. 1 is a cross-sectional structural view when an upper heating body and a lower heating body according to the present invention are closed.
Figure 2:
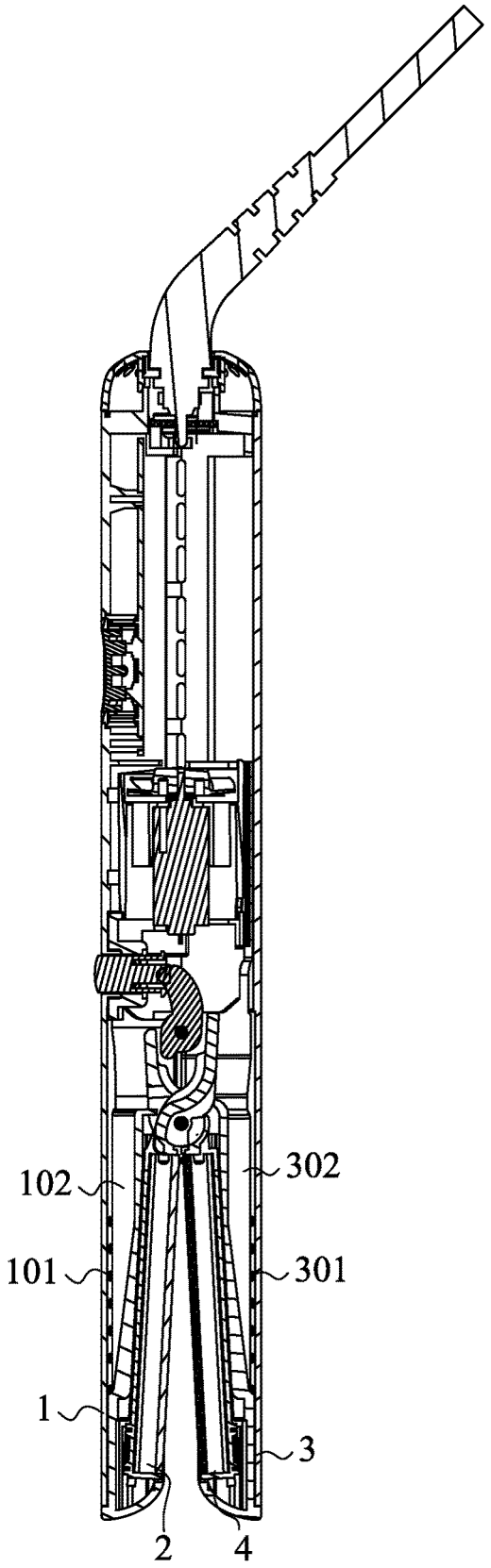
FIG. 2 is a cross-sectional structural view when an upper heating body and a lower heating body according to the present invention are opened.
Figure 3:
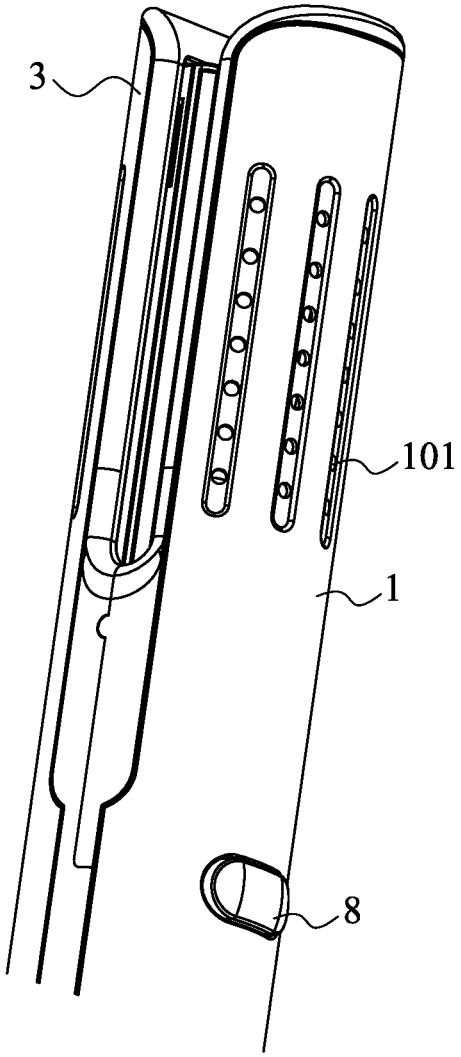
FIG. 3 is a partial schematic view of the present invention.

As shown in FIG. 1 to FIG. 3, the multifunctional hair straightening and curling device includes an upper main body 1, a lower main body 3 and a handle 6. The upper main body 1 and the lower main body 3 are disposed oppositely, and one end of each of the upper main body 1 and the lower main body 3 is mounted on the end part of the handle 6. An upper heating body 2 and a lower heating body 4 are disposed between the upper main body 1 and the lower main body 3 respectively. The upper heating body 2 is disposed on the upper main body 1, and the lower heating body 4 is disposed on the lower main body 3. One end of the upper heating body 2 and one end of the lower heating body 4 are rotatably connected by a rotary shaft 7. A button 8 is disposed on the upper main body 1. An elastic component is arranged in the upper heating body 2 and the lower heating body 4. After the upper heating body 2 and the lower heating body 4 are opened and release the hair, the button controlling the upper heating body 2 and the lower heating body 4 to be opened is loosened, and the upper heating body 2 and the lower heating body 4 automatically clamp the hair. The button 8 is capable of controlling the upper heating body 2 and the lower heating body 4 to perform opening-closing movement. The upper surface of the upper main body 1 is provided with first air outlets 101, and the upper main body 1 is provided with a first air outlet passage 102 therein. The lower surface of the lower main body 3 is provided with second air outlets 301, and the lower main body 3 is provided with a second air outlet passage 302 therein. The handle 6 is provided with a fan 5 therein. The fan 5 is capable of blowing generated wind out from the first air outlets 101 through the first air outlet passage 102. The fan is capable of blowing the generated wind out from the second air outlets 301 through the second air outlet passage 302.

According to the present invention, the upper surface of the upper main body 1 is provided with the first air outlets 101, and the upper main body 1 is provided with the first air outlet passage 102 therein. The lower surface of the lower main body 3 is provided with the second air outlets 301, and the lower main body 3 is provided with the second air outlet passage therein 302. The handle 6 is provided with the fan 5 therein. The fan 5 is capable of blowing the generated wind out from the first air outlets 101 through the first air outlet passage 102, and the fan is capable of blowing the generated wind out from the second air outlets 301 through the second air outlet passage 302. The hair is heated by the upper heating body 2 and the lower heating body 4, and is then wound on a cylindrical body combined by the upper main body 1 and the lower main body 3. Under the radiating action of wind, the hair is cooled and set instantly, and moves toward the direction opposite to hair roots. The multifunctional hair straightening and curling device will generate a continuous hair curling effect, and thus saves a lot of time. Multiple different hair set effects can be curled according to the moving speed of the multifunctional hair straightening and curling device.

Further, the upper heating body 2 and the lower heating body 4 are capable of opening for a certain angle, and the vertical width between the upper heating body 2 and the lower heating body 4 ranges from 1 mm to 8 mm.

Figure 4:
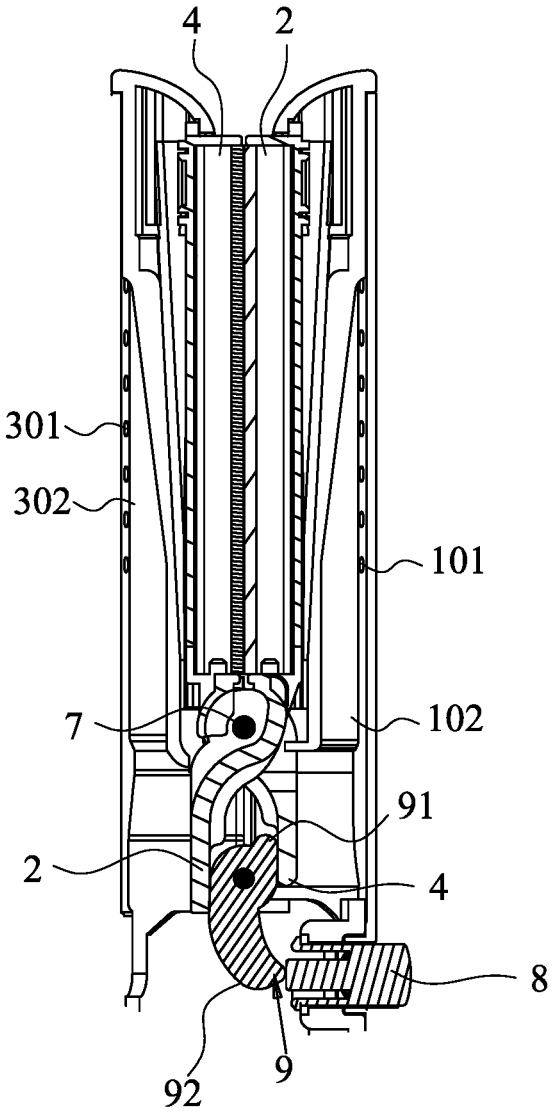
FIG. 4 is a partial cross-sectional structural view when an upper heating body and a lower heating body according to the present invention are closed.
Figure 5:
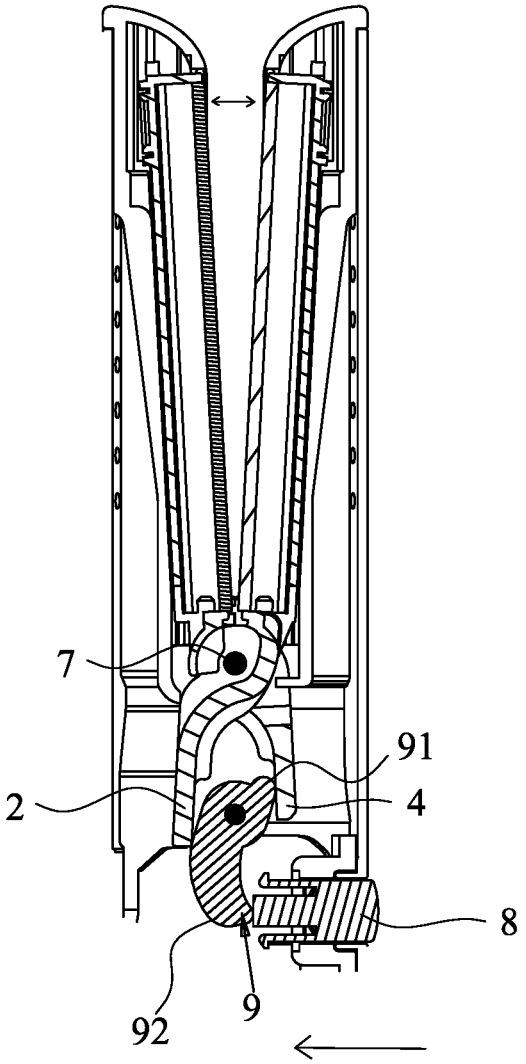
FIG. 5 is a partial cross-sectional structural view when an upper heating body and a lower heating body according to the present invention are opened.

As shown in FIG. 4 to FIG. 5, the upper heating body 2 and the lower heating body 4 are connected in a scissor shape by a rotary shaft 7. A rotary handle 9 is disposed on the right end of the upper heating body 2 and the lower heating body 4. The left end of the rotary handle 9 is provided with a boss part 91 capable of abutting against the right end of the lower heating body 4. The right end of the rotary handle 9 is provided with an extending part 92 capable of abutting against the right end of the upper heating body 2, and the extending part 92 is bent rightwards and extends upwardly and is connected to the lower end of the button 8.

During the use of the present invention, the button 8 is pressed, and the button 8 downwardly pushes the extending part 92 of the rotary handle 9, so as to drive the rotary handle 9 to rotate clockwise. When the rotary handle 9 rotates clockwise, the boss part 91 of the rotary handle 9 upwardly pushes the lower heating body 4 to rotate counterclockwise around the rotary shaft 7, so that the lower heating body 4 is opened downwardly. While the rotary handle 9 rotates clockwise, the extending part thereof also pushes the upper heating body 2 to rotate clockwise around the rotary shaft 7, so that the upper heating body 2 is upwardly opened.

The foregoing is not limitative to the technical scope of the present invention in any way. Any amendments, equivalent changes and modifications made on the above embodiments according to the technical essence of the present invention all belong to the scope of the technical solution of the present invention.

What is claimed is:

1. A multifunctional hair straightening and curling device, comprising: an upper main body, a lower main body, and a handle, wherein the upper main body is positioned opposite the lower main body, one end of each of the upper main body and the lower main body joins an end part of the handle, an upper heating body and a lower heating body are disposed between the upper main body and the lower main body respectively, the upper heating body is disposed on the upper main body, the lower heating body is disposed on the lower main body, one end of the upper heating body and one end of the lower heating body are rotatably connected by a rotary shaft to form a first free end and a second free end respectively, a button is disposed on the upper main body, the button is capable of controlling the upper heating body and the lower heating body to perform opening-closing movement of the device, an upper surface of the upper main body is provided with a first air outlet, the main body is provided with a first air outlet passage therein, a lower surface of the lower main body is provided with a second air outlet, the lower main body is provided with a second air outlet passage therein, the handle is provided with a fan therein, the fan is configured to create an airflow such that the airflow leaves the fan, enters the first and second air outlet passages, then exits the multifunctional hair straightening and curling device through the first and second air outlets;

wherein the first free end and the second free end are spaced apart from each other by a first distance and are both located at a side of the rotary shaft near the button;

wherein a rotary handle is sandwiched between the first free end of the upper heating body and the second free end of the lower heating body, the rotary handle is pivotably connected with the another rotary shaft and the rotary handle is independent from the upper heating body and the lower heating body, a left end of the rotary handle is provided with a boss part capable of abutting against the second free end of the lower heating body, a right end of the rotary handle is provided with an extending part capable of abutting against the first free end of the upper heating body, and the extending part is bent rightwards and extends upwardly and is connected to a lower end of the button;

wherein the button is configured to drive the rotary handle to rotate clockwise after being pressed and thereby the boss part of the rotary handle pushes the second free end of the lower heating body to rotate counterclockwise around the rotary shaft and meanwhile the extending part of the rotary handle pushes the first free end of the upper heating body to rotate clockwise around the rotary shaft, thereby increasing the first distance.

2. The multifunctional hair straightening and curling device according to claim 1, wherein the upper heating body and the lower heating body are capable of being in an open position that a vertical distance between the upper heating body and the lower heating body ranges from lmm to 8mm.

3. The multifunctional hair straightening and curling device according to claim 1, wherein the lower heating body is opened downwardly and meanwhile the upper heating body is upwardly opened when the rotary handle is driven to rotate clockwise by the button.

4. The multifunctional hair straightening and curling device according to claim 1, wherein the second free end of the lower heating body is closer to the button in a vertical direction than the first free end of the upper heating body.

* * * * *